US005881967A

United States Patent [19]

Dawson et al.

[11] Patent Number: 5,881,967

[45] Date of Patent: Mar. 16, 1999

[54] DEVICE FOR USE IN DISPENSING WIRE

[76] Inventors: Dennis Dawson, 1002 Towerview St. SW., Decatur, Ala. 35603; Barry Alexander Huff, 1217 Brandywine La. SE., Decatur, Ala. 35601

[21] Appl. No.: 788,176

[22] Filed: Jan. 24, 1997

[51] Int. Cl.[6] ..... B65H 49/28; B65H 49/32

[52] U.S. Cl. ..... 242/593; 242/594.5; 242/597.7; 242/129

[58] Field of Search ..... 242/593, 594.5, 242/594.6, 597.7, 129, 129.5, 137.1, 146, 132

[56] References Cited

U.S. PATENT DOCUMENTS

| | | | |
|---|---|---|---|
| 1,329,240 | 1/1920 | Hays . | |
| 1,390,632 | 9/1921 | Metzger . | |
| 2,286,460 | 6/1942 | Brown . | |
| 2,985,404 | 5/1961 | Tashiro . | |
| 2,990,135 | 6/1961 | Croteau et al. | 242/129 |
| 3,072,358 | 1/1963 | Knapp . | |
| 3,292,877 | 12/1966 | McMasters . | |
| 3,371,885 | 3/1968 | Douglas . | |
| 3,464,647 | 9/1969 | Jacobi . | |
| 3,602,455 | 8/1971 | Lewis . | |
| 3,780,964 | 12/1973 | Gonzalez . | |
| 3,990,653 | 11/1976 | Marcell | 242/129 |
| 4,015,795 | 4/1977 | Chong . | |
| 4,068,971 | 1/1978 | McNeill | 242/597.7 |
| 4,471,921 | 9/1984 | Corbin . | |
| 4,552,323 | 11/1985 | Otis . | |
| 4,765,560 | 8/1988 | Branback . | |
| 4,826,100 | 5/1989 | Belliveau . | |
| 5,078,332 | 1/1992 | Carter . | |
| 5,242,255 | 9/1993 | Gleffe et al. . | |
| 5,312,005 | 5/1994 | Odell . | |
| 5,348,241 | 9/1994 | Huette | 242/129 |
| 5,692,625 | 12/1997 | Filipescu et al. | 242/594.6 |

*Primary Examiner*—John M. Jillions
*Attorney, Agent, or Firm*—Mayer, Brown & Platt

[57] ABSTRACT

The present invention is directed to a device for dispensing a straightened length of coiled wire through an "O" ring portion of the frame of the dispenser. The dispenser includes coupling mechanisms which permits multiple dispensers to be joined and used together.

10 Claims, 3 Drawing Sheets

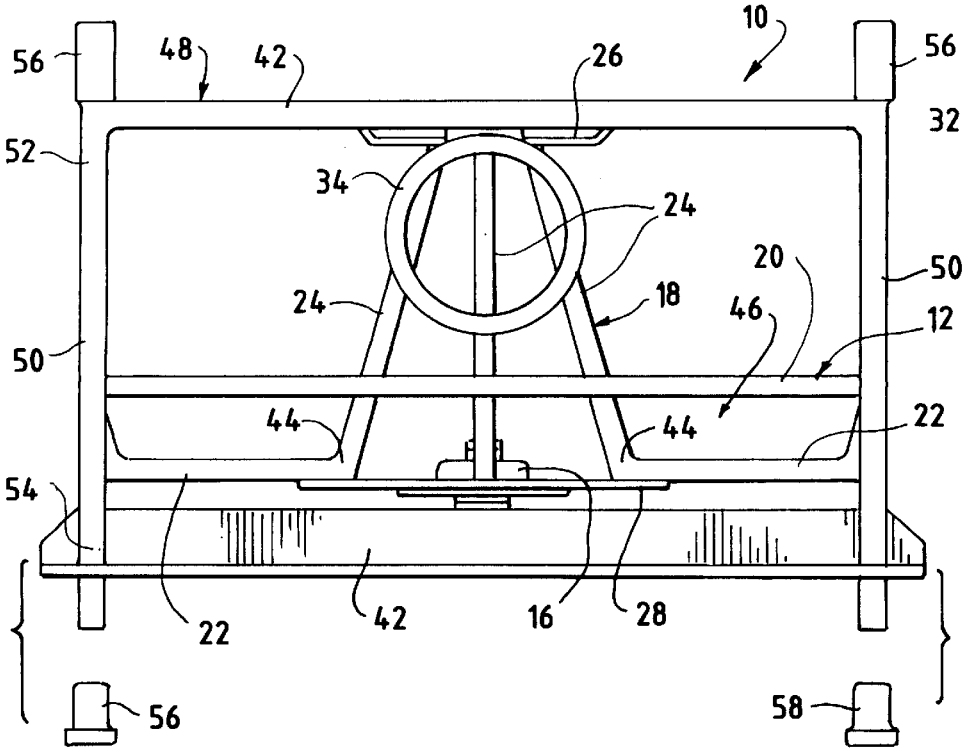
FIG. 2
FIG. 3
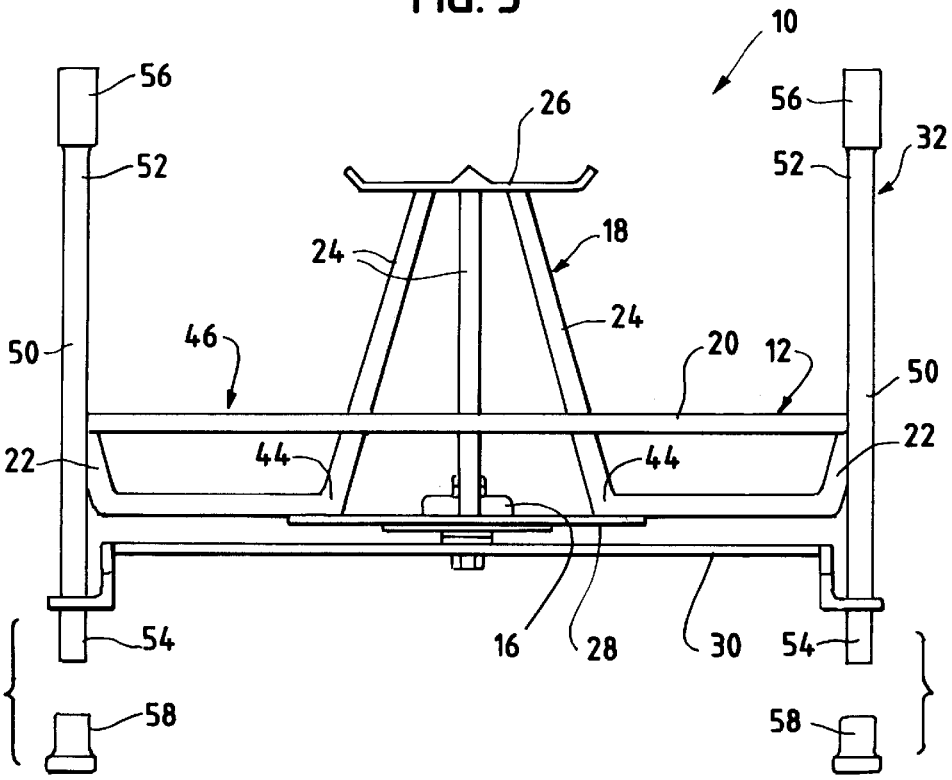

DEVICE FOR USE IN DISPENSING WIRE

FIELD OF THE INVENTION

The present invention relates generally to coiled electrical wire, and more particularly to a device for dispensing a straightened length of coiled electrical wire.

BACKGROUND OF THE INVENTION

Electrical wire used in the construction of residential and commercial buildings is generally provided either wound on reels or in an annular coiled configuration. Coiled wire is commonly referred to as Romex or boxed coils. Coiled wire is provided, as the name suggests, in a coiled annular configuration where one free end of the wire is paid out from the center of the coil. Because coiled wire is generally provided in shorter lengths than those found on wound reels, coiled wire is less bulky, weighs less and is generally less expensive to use than wound reels. As a result, electricians generally prefer to use coiled wire. However, despite being the preferred choice for electricians, coiled wire does have drawbacks.

One major drawback is that the coiled wire is not immediately useable when withdrawn from the coil. When an electrician pulls a length of wire from the center of the coil it creates a twisting effect when the wire is dispensed. For example, if an electrician simply reaches into the center of the coil and pulls out a length of coil, the wire will remain in its coiled configuration and not become straight. In order to use the wire, the wire must be twisted and formed into straight sections. To eliminate the twist in most situations requires two people, one to do the pulling while the other untwists the product as it comes out of the coil. Because it is undesirable to use coiled wire when it is in its spiral form when first withdrawn from the coil, the above described straightening task must be undertaken. As can be appreciated, this process is cumbersome and extremely time consuming.

The necessity to straighten coiled wire highlights another problem associated with the use of coiled wire. Electricians and other individuals frequently will use more than one gauge or size of wire together where both sizes are required to be of the same length. Consequently, a person who needed to use two different gauges of wire was previously required to pull one length of wire and straighten it out and then pull a second length of wire of a different gauge and then straighten it out before both wires could be used together in the desired task. Attempts to simultaneously pull two different gauges or colors of the same gauge wire often resulted in undesirable entanglement of the two wires.

Therefore, a need exists for a coiled wire dispenser which does not require two individuals to straighten the desired length of wire that is being dispensed.

Furthermore, there is a need for a coiled wire dispenser which permits more than one gauge of wire to be dispensed simultaneously as well as to be straightened simultaneously.

Accordingly, it is an object of the present invention to provide a dispenser that permits an individual to get a desired length of coiled wire that is straightened during the dispensing process.

It is another object of the present invention to provide a device which permits an electrician or individual to draw lengths of different gauges of coiled wire simultaneously and also straighten each of the simultaneously drawn wires without the assistance of another individual.

It is still another object of the present inventor to provide a device that permits the display of multiple gauges of wire.

SUMMARY OF THE INVENTION

The purpose and advantages of the present invention will be set forth in and apparent from the description that follows, as well as will be learned by practice of the invention. Additional advantages of the invention will be realized and attained by the methods and apparatus particularly pointed out in the written description as well as from the appended drawings.

In view of the above needs, a coiled wire dispenser is disclosed which overcomes difficulties found in the existing systems. The dispenser of the present invention includes an annular shaped basket formed from tubular steel coupled with a centering member also formed from tubular steel that together define a coiled wire receiving and support area. The centering member, which forms part of the basket and defines the inner edge of the wire receiving area extends upwardly and inwardly to a top plate and assists in maintaining the coiled wire centered in the basket.

A base plate is provided opposite the top plate which supports the basket and centering member and includes a rotatable bearing that permits the basket to rotate freely. The basket, base plate and centering member are carried on an "H"-shaped frame having a pair of upstanding frame members. An "O"-ring is formed in one of the upstanding frame members through which the free end of coiled wire travels as it is pulled from the coiled wire positioned in the basket. Each of the upstanding frame members has at least two support legs and each leg has an upper and lower end. The upstanding frame member is generally formed from steel tubing having a predetermined outer diameter. The upper end of each of the legs has a tube shaped coupler having an inner diameter substantially equal to the outer diameter of each leg. The couplers are configured to receive the lower ends of each leg of a similarly constructed dispenser to permit multiple units of the coiled wire dispensers to be stacked one upon the other safely and securely.

The multiple stacking thus permits an individual to have access to several sizes of wire at one time without having to undertake changing out the coils. In addition, the present invention may be used in a retail environment. In the case of a retailer, the present invention would permits a retailer to offer accessibility to several different wire sizes in a minimum amount of floor space thereby reducing the space necessary to stock several different wire sizes.

It is to be understood that both the foregoing general description and the following detailed description are not limiting but are intended to provide further explanation of the invention claimed. The accompanying drawings, which are incorporated in and constitute part of this specification are included to illustrate and provide a further understanding of the method and system of the invention. Together with the description, the drawings serve to explain the principles of the invention.

BRIEF DESCRIPTION OF THE DRAWINGS

FIG. 2 is a front view of the coiled wire dispenser of the present invention illustrating the "O"-ring.

FIG. 3 is a side view of the coiled wire dispenser of the present invention.

DESCRIPTION OF THE PREFERRED EMBODIMENT

Figure 1:
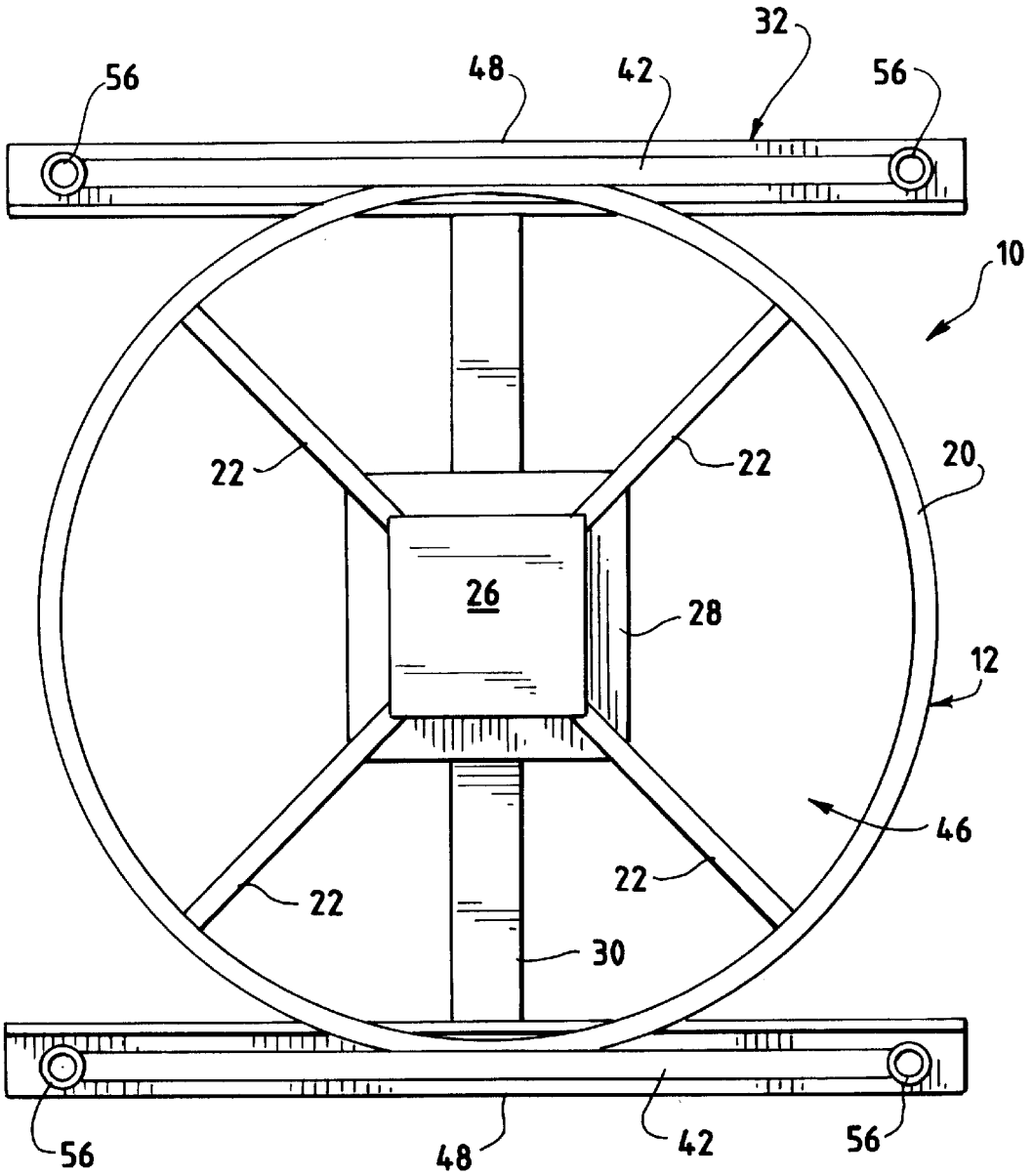
FIG. 1 is a top view of the coiled wire dispenser of the present invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

The present invention relates to a coiled wire dispenser including an "O"-ring exit from the dispenser which straightens the coiled wire as it is paid out. As will be explained, the dispenser may be used with various gauge and lengths of coiled wire and is intended to straighten wire as it is pulled from the coil. Multiple units of the dispenser may be used to provide accessibility and straightening to several different wire sizes simultaneously.

With reference to the drawings, wherein like reference numerals indicate like parts throughout the drawings, FIG. 1 shows dispenser 10 which includes a basket assembly 12, a center section 18, base 28 and an "H"-shaped support assembly 32.

The basket assembly 12 is generally circular and includes a circular top rim 20. The rim is preferably made from iron or steel tubing as is the entire structure of the dispenser 10. Alternatively, the dispenser 10 may be constructed of durable plastic. Four basket frame members 22 extend downwardly and then radially inwardly from the circular rim 20. The four basket frame members 22 are generally spaced circumferentially 90° apart with respect to the circular rim 20. The four basket frame members 22 extend radially inwardly and are joined to a center section 18. Any number of basket frame members 22 sufficient to support a coil of wire may be used and spaced apart circumferentially. The number of basket frame members 22 should not be so large and spaced so closely together so as to completely obstruct an individual's view into the basket 12. By keeping the frame members sufficiently spaced, an individual may be able to readily identify the gauge of wire contained in the basket by a quick visual inspection.

Center section 18 includes four upright angled rod members 24 circumferentially spaced 90° apart. Each of the angled rod member are joined at their respective base 44 to one of the basket frame members 22. Preferably, each of the angled rod members 24 and the basket frame members 22 are of one piece construction. The four upright angled rods 24 extend upwardly and inwardly from their base 44 to a top plate 26. The upright angled rods 24 are connected to the underside of the top plate 26 preferably by welding. The center section 18 which includes the four upright angled rods 24 and the top plate 26 form a generally frusto-conical configuration.

It should be apparent that the four basket frame members 22, the four upright angled rods 24 and the circular rim 20 cooperate to form an interior coiled wire receiving area 46 of the basket assembly 12. In addition, the spacing between the frame members 22 permits an individual to view the coiled wire (not shown) carried in the receiving area 46 without any significant obstruction from the dispenser.

A base plate 28 is provided opposite and beneath the top plate 26. The center of the base plate is aligned with the center line A of the center section 18. The basket 12 including a portion of the four basket frame members 22 and the four upright angled rods 24 are secured to the base plate 28. The base plate 28 is carried on a ball-bearing mechanism 16 that permits the entire basket structure 12 including the center section 18 to rotate freely about a substantially vertical axis A.

The size of the basket 12 and wire receiving area 46 should be sufficiently large enough to receive various gauge and lengths of coiled wire. Preferably, the preformed basket should measure approximately 15½" across and approximately 1" to 2" deep. In addition, the circumferentially opposed upright angled rods 24 should be spaced apart approximately 5" at the base 44 and 3½" at the top plate. It should be understood that these measurements are exemplary and are intended to permit the use of a majority of the commercially available coiled wire packages. Commercially available coiled wire generally is provided in 250 and 500 foot lengths. However, a variety of dimensions for the basket 12 and center section 18 may be provided to accommodate any sized coiled wire package.

The entire basket structure 12 including the base plate 28 and ball bearing mechanism 16 is carried on an "H"-shaped frame 32. The frame 32 includes a bottom support member 30 that intersects the axis of rotation A of the basket structure 12 and is perpendicularly joined to two spaced apart upstanding frames 48. The basket structure 12 is connected to the support member 30, for example, by a nut.

The upstanding frames 48 each include a pair of upright legs 50. The legs 50 include an upper portion 52 and a lower portion 54. The legs of each frame 48 are connected together at their upper portion and their bottom portion respectively by cross members 42 to provide stability. The upright legs 50 are preferably formed from tubular steel having a predetermined outer diameter. Near the upper portion 52 of each upright leg 50 a cylindrical coupler 56 is provided that has an inner diameter substantially equal to the outer diameter of the upright leg 50. The coupler may alternatively be disposed on the lower portion of legs 50. The coupler 56 permits the lower portion 54 of the upright leg 50 of a similarly formed coiled wire dispenser 10 to be inserted and received in the coupler 56. The lower portion 54 of legs 50 are maintained in the coupler 56 by interference fit. It should be understood that the coupler as well as the steel tubing that is used in the dispenser may be square in cross-section. Thus, the coupler and the lower ends of the legs 50 need only to have complementary dimensions which permit the coupler 56 and leg 50 to engage.

At least one of the upstanding frames 48 includes an "O"-ring 34 formed from the tubing and disposed generally in the center of the upstanding frame 48. The "O"-ring should be of a diameter large enough to accommodate various gauge wire. It is preferred that the "O"-ring diameter be several times larger than the diameter of the wire to avoid having to "thread" the wire through the "O"-ring. Rubber tips 58 may be provided to be inserted into the lower portions of the upright legs 50 to prevent scratching and provide stability to the dispenser 10 when it is placed on the ground.

In operation, when an individual desires a given length of wire from a coiled wire package, the individual need only grasp the free end of the coiled wire carried in dispenser 10 pulling it through the "O"-ring 34 and cutting the wire at its desired length. Pulling the wire through the "O"-ring 34, coupled with the ability of the basket 12 to rotate about axis A, straightens the wire as it is drawn from the coil. No additional assistance or straightening is required.

Figure 4:
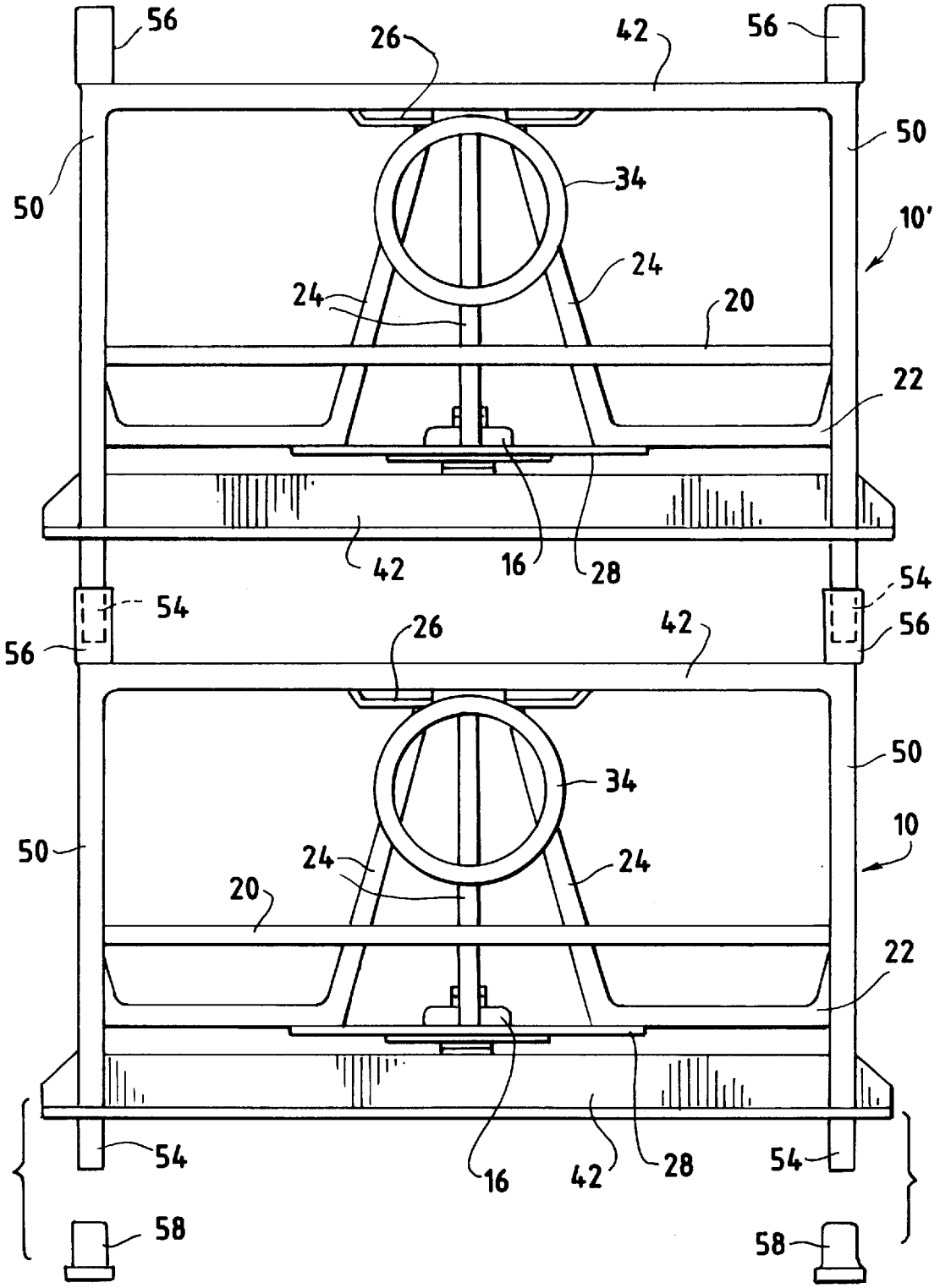
FIG. 4 is a front view of multiple units of the coiled wire dispenser of the present invention stacked one on top of another.

As illustrated in FIG. 4 it should now be apparent that the coiled wire dispenser 10 of the present invention may be stacked one on top of another. In that configuration, access to wires of various gauges is provided. Referring again to FIG. 4, it can be seen that the bottom portions 54 of upstanding legs 50 of a dispenser 10' may be inserted into the coupling member 56 of a similarly configured dispenser 10. Of course, it should be understood that when stacking multiple units of the coiled wire dispenser 10 the rubber tips 58 of dispenser 10' to be carried on another dispenser 10 should be removed so that the lower portion of the legs 50 can be received into the coupler of the cooperating dispenser 10.

Additionally, FIG. 4 illustrates situations where the same length of a series of different gauge wires is required, an individual may stack a series of dispensers 10 and 10', one on top of the other, wherein each contains the gauge of wire desired. The individual may then draw the wires simultaneously from each of the coiled wire packages. This arrangement of dispensers 10 and 10' permits the individual to draw various gauges of wire without the need for an assistant to help straighten the wire once it is removed from the coil and cut to its desired length. As a result, an electrician, for example, may then immediately use the wire and provide a more efficient and less costly service. It will be apparent to those skilled in the art that various modifications and variations can be made in the method and system of the present invention without departing from the spirit or scope of the invention. Thus it is intended that the present invention cover modifications and variations that come within the scope of the spirit of the invention and the claims that follow.

It should also be apparent the dispenser 10 could be used in a retail environment where purchasers select a given length of wire to be used in home repairs, for example. The ability of dispenser 10 to be stacked permits the retailer to provide a wide selection of wires in a minimal amount of floor space.

What is claimed is:

1. A coiled wire dispenser comprising:

a basket structure including an annularly shaped basket having an inner diameter and outer diameter, a centering member connected to said basket extending upwardly and inwardly from said inner diameter to a top plate, said centering member cooperating with said annularly shaped basket to form an interior area of said basket, and a base plate supporting said basket, said base plate including a rotatable bearing that permits the basket to rotate around a substantially vertical axis;

an "H"-shaped support having a pair of upstanding frame members connected by a center support for carrying said basket structure, each upstanding frame member including a pair of spaced apart upright legs each having an upper and lower end, said upright legs including a coupling member disposed on one of either of said upper ends, said coupling member having a receiving area complementary to said upright legs and configured to receive one of either the lower ends or upper ends of said upstanding legs from a similarly configured dispenser; and an "O"-ring formed in at least one of said upstanding frame members.

2. The dispenser of claim 1 wherein said centering member is formed integrally with said basket.

3. The dispenser of claim 1 wherein said dispenser is formed from tubular steel.

4. The dispenser of claim 1 wherein said upright legs of each upstanding frame member are joined at their upper and lower ends by cross members.

5. The dispenser of claim 1 wherein said coupling member is a cylindrical tube having an inner diameter substantially equal to the outer diameter of the upright legs.

6. The dispenser of claim 1 wherein said basket includes a circular rim and a plurality of circumferentially spaced frame supports extending downwardly and gradually inwardly from said circular rim.

7. A first coiled wire dispenser as recited in claim 1 and a second coiled wire dispenser as recited in claim 1 disposed on top of said first coiled wire dispenser wherein the lower ends of said upright legs of said second coiled wire dispenser are received in and engaged to said coupling members of said first coiled wire dispenser.

8. A plurality of coiled wire dispensers comprising a first coiled wire dispenser including an annularly shaped basket having an inner diameter and outer diameter, a centering member connected to said basket extending upwardly and inwardly from said inner diameter to a top plate, said centering member cooperating with said annularly shaped basket to form an interior area of said basket and a base plate supporting said basket, said base plate including a rotatable bearing that permits the basket to rotate around a substantially vertical axis;

an "H"-shaped support having a pair of upstanding frame members connected by a center support for carrying said basket, each upstanding frame member including a pair of spaced apart upright legs each having an upper and lower end, said upright legs including a coupling member disposed on each of said upper ends, said coupling member having a receiving area complimentary to the lower ends of said upright legs; and an "O" ring formed in one of said upstanding frame members;

a second coil wire dispenser supporting said first coiled wire dispenser, said second coiled wire dispenser including;

an annularly shaped basket having an inner diameter and outer diameter, a centering member connected to said basket extending upwardly and inwardly from said inner diameter to a top plate, said centering member cooperating with said annularly shaped basket to form an interior area of said basket, a base plate supporting said basket, said base plate including a rotatable bearing that permits the basket to rotate around a substantially vertical axis;

an "H"-shaped support having a pair of upstanding frame members connected by a center support for carrying said basket, each upstanding frame member including a pair of spaced apart upright legs having upper and lower ends, and at least one of said upstanding legs having an "O"-ring formed therein, said upright legs including a coupling member disposed on each of said upper ends, said coupling member having a receiving area said lower ends of said first coiled wire dispenser wherein lower ends of said first coiled wire dispenser are disposed in and engaged with said coupling members of said second coiled wire dispenser.

9. A method of straightening a desired length of coiled wire as it is dispensed comprising:

providing a coiled wire dispenser including a basket structure including an annularly shaped basket having an inner diameter and outer diameter, a centering member connected to said basket extending upwardly and inwardly from said inner diameter to a top plate, said centering member cooperating with said annularly shaped basket to form an interior area of said basket, and a base plate supporting said basket, said base plate including a rotatable bearing that permits the basket to rotate around a substantially vertical axis z, an "H"-shaped support having a pair of upstanding frame members connected by a center support for carrying said basket structure, each upstanding frame member including a pair of spaced apart upright legs each having an upper and lower end, said upright legs including a coupling member disposed on one of either of said upper ends, said coupling member having a receiving area complementary to said upright legs and configured to receive one of either the lower ends or upper ends of said upstanding legs from a similarly configured dispenser, and an "O"-ring formed in at least one of said upstanding frame members;

inserting a coil of wire having a free end into said wire receiving area;

threading the free end of said coil wire through said "O" ring pulling a desired length of wire through said "O" ring.

10. A wire dispenser comprising:

a basket having a wire receiving and support area;

a base carrying said basket and including a rotatable bearing for permitting said basket to rotate about a substantially vertical axis;

a frame for supporting said basket and base, said frame including at least one "O"ring disposed thereon and a plurality of support legs of predetermined cross-sectional dimensions having an upper end and a lower end, a coupling mechanism disposed on one of either said upper or lower end of said legs and having a predetermined cross-sectional dimension complementary to the cross-sectional dimensions of said legs, whereby one of either said upper or lower ends of said legs of a similarly configured wire dispenser will engage said couplers.

* * * * *